US009953756B2

(12) United States Patent
Marketos et al.

(10) Patent No.: US 9,953,756 B2
(45) Date of Patent: Apr. 24, 2018

(54) RADIO FREQUENCY TRANSFORMER WINDING COIL STRUCTURE

(71) Applicant: PPC Broadband, Inc., East Syracuse, NY (US)

(72) Inventors: Leon Marketos, Auburn, NY (US); Erdogan Alkan, Fayetteville, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 240 days.

(21) Appl. No.: 13/948,315

(22) Filed: Jul. 23, 2013

(65) Prior Publication Data

US 2015/0028981 A1 Jan. 29, 2015

Related U.S. Application Data

(60) Provisional application No. 61/703,802, filed on Sep. 21, 2012.

(51) Int. Cl.

| | |
|---|---|
| ***H01F 27/30*** | (2006.01) |
| ***H01F 27/28*** | (2006.01) |
| ***H01F 17/04*** | (2006.01) |
| ***H01F 27/00*** | (2006.01) |
| ***H01F 27/255*** | (2006.01) |

(Continued)

(52) U.S. Cl.

CPC ..... *H01F 27/006* (2013.01); *H01F 27/255* (2013.01); *H01F 27/2895* (2013.01); *H01F 41/0206* (2013.01); *H01F 41/06* (2013.01); *H01F 41/08* (2013.01); *H01F 17/062* (2013.01); *H01F 2003/106* (2013.01); *Y10T 29/49071* (2015.01)

(58) Field of Classification Search

CPC .. H01F 27/006; H01F 27/255; H01F 27/2823; H01F 27/2895; H01F 41/0206; H01F 41/06; H01F 17/062; H01F 2003/106; H01F 27/324; Y10T 29/49071

USPC ..... 336/188, 189, 196, 198, 221, 199; 29/605

See application file for complete search history.

(56) References Cited

U.S. PATENT DOCUMENTS

| | | | |
|---|---|---|---|
| 1,133,750 | A | 3/1915 | Shaw |
| 1,231,193 | A | 6/1917 | Powers |

(Continued)

FOREIGN PATENT DOCUMENTS

| | | | |
|---|---|---|---|
| EP | 0475522 | A1 | 3/1992 |
| EP | 0499311 | A1 | 8/1992 |

OTHER PUBLICATIONS

REF1: Park, J et al. 'Ferrite-Based Integrated Planar Inductors and Transformers', IEEE Trans. Magnetics, Sep. 1997, vol. 33, No. 5, pp. 3322-3324, ISSN 0018-9464 [online], [retrieved on Jan. 14, 2014]. Retreived from the Internet: <URL: http://www.mems.gatech.edu/msmawebsite_2006/publications/publication_list_files/1997/Ferrite-Based%20Integrated%20Planar°/020IndUctors%20and%20Transformers%20Fabricated%20at%20Low%20Temperature.pdf>; the entire document.

(Continued)

*Primary Examiner* — Mangtin Lian

(74) *Attorney, Agent, or Firm* — MH2 Technology Law Group LLP

(57) ABSTRACT

An RF transformer is provided. The RF transformer includes a ferrite core and a winding coil structure formed around the ferrite core. The winding coil structure is in electrical contact with a center portion of the ferrite core. The winding coil structure is essentially electrically and physically spaced from external portions of the ferrite core.

12 Claims, 13 Drawing Sheets

(51) Int. Cl.

| | |
|---|---|
| ***H01F 41/02*** | (2006.01) |
| ***H01F 41/06*** | (2016.01) |
| ***H01F 41/08*** | (2006.01) |
| *H01F 17/06* | (2006.01) |
| *H01F 3/10* | (2006.01) |

(56) References Cited

U.S. PATENT DOCUMENTS

| | | | | |
|---|---|---|---|---|
| 3,413,574 | A | 11/1968 | Schroeder | |
| 4,551,700 | A | 11/1985 | Waldemar | |
| 4,975,672 | A * | 12/1990 | McLyman | H01F 17/062 174/DIG. 8 |
| 5,390,349 | A | 2/1995 | Joshi et al. | |
| 5,473,300 | A | 12/1995 | Watson | |
| 5,677,651 | A | 10/1997 | Crane | |
| 5,929,738 | A * | 7/1999 | Orlando | 336/180 |
| 7,724,118 | B1 * | 5/2010 | Chen | H01F 19/08 336/220 |
| 2003/0030534 | A1 | 2/2003 | Gu et al. | |
| 2004/0119577 | A1 | 6/2004 | Weger | |
| 2005/0146326 | A1 | 7/2005 | Li | |
| 2005/0162237 | A1 * | 7/2005 | Yamashita | H01F 19/08 333/177 |
| 2011/0167869 | A1 | 7/2011 | Geers et al. | |
| 2011/0234352 | A1 * | 9/2011 | MacLennan | H01F 17/06 336/61 |
| 2012/0092112 | A1 | 4/2012 | McClelland et al. | |
| 2014/0266536 | A1 * | 9/2014 | Lu | 336/178 |

OTHER PUBLICATIONS

REF2: Park, J et al. 'Ultralow-Profile Micromachined Power Inductors With Highly Laminated Ni/Fe Cores: Application to Low-Megahertz DC-DC Converters', IEEE Trans. Magnetics, Sep. 1997, vol. 39, No. 5, pp. 3184-3186, ISSN 0018-9464 [online], [retrieved on Jan. 14, 2014]. Retrieved from the Internet: <URL: http://www.mems.gatech.edu/msma/publications/2003/Ultra-low-profil0/020micromachined%20power%20inductors%20with%2Ohighly°/0201aminated%20NiFe%20cores%20application% 20to%20low %20MHz%20DC-DC%20converters.pdf> <DOI: 10.1109/TMAG.2003.816051>; p. 3184.

ISR: PCT/US13/60846:International Search Report and Written Opinion; dated Mar. 10, 2014; 7 Pages.

Partial European Search Report dated Apr. 19, 2016, European Application No. 13840038.7, filed Sep. 20, 2013, pp. 1-6.

Extended European Search Report dated Aug. 4, 2016, European Application No. 13840038, filed Sep. 20, 2013, pp. 1-12.

* cited by examiner

RADIO FREQUENCY TRANSFORMER WINDING COIL STRUCTURE

CROSS-REFERENCE TO RELATED APPLICATIONS

This application claims priority to U.S. Provisional Application Ser. No. 61/703,802 filed on Sep. 21, 2012.

BACKGROUND

Technical Field

The present invention relates to RF transformers and, more particularly, an RF transformer with a unique winding structure.

Related Art

High bandwidth components are useful for a variety of purposes, including operation with a wide spectrum of frequencies. Various materials used in construction of high bandwidth components may result in trade off of various parameters. A trade off of various parameters may cause a decrease in performance. Accordingly, there exists a need in the art to overcome at least some of the deficiencies and limitations described herein above.

SUMMARY

The present invention provides a structure for use with RF components that offers improved performance.

A first object of the present invention provides an RF transformer including: a ferrite core; and a winding coil structure formed around the ferrite core, wherein the winding coil structure is in electrical contact with a center portion of the ferrite core, and wherein the winding coil structure is essentially electrically and mechanically spaced from external portions of the ferrite core.

A second object of the present invention provides an RF transformer including: a ferrite core structure comprising a plurality of ferrite cores; and a winding coil structure formed around the ferrite core structure, wherein said winding coil structure is in electrical contact with a center portion of each ferrite core of the plurality of ferrite cores, and wherein the winding coil structure is essentially electrically and physically spaced from external portions of each the ferrite core.

A third object of the present invention provides a method for forming an RF transformer, the method including: forming a ferrite core; and forming a winding coil structure around the ferrite core, wherein the winding coil structure is in electrical contact with a center portion of the ferrite core, and wherein the winding coil structure is essentially electrically and physically spaced from external portions of the ferrite core.

A fourth object of the present invention provides a method for forming an RF transformer, the method including: forming a ferrite core structure comprising a plurality of ferrite cores; and forming a winding coil structure around the ferrite core structure, wherein the winding coil structure is in electrical contact with a center portion of each ferrite core of the plurality of ferrite cores, and wherein the winding coil structure is essentially electrically and physically spaced from external portions of each ferrite core.

The foregoing and other features of the invention will be apparent from the following more particular description of various embodiments of the invention.

DESCRIPTION OF THE DRAWINGS

The present invention will be more fully understood and appreciated by reading the following Detailed Description in conjunction with the accompanying drawings, in which.

DETAILED DESCRIPTION

Figure 1A:
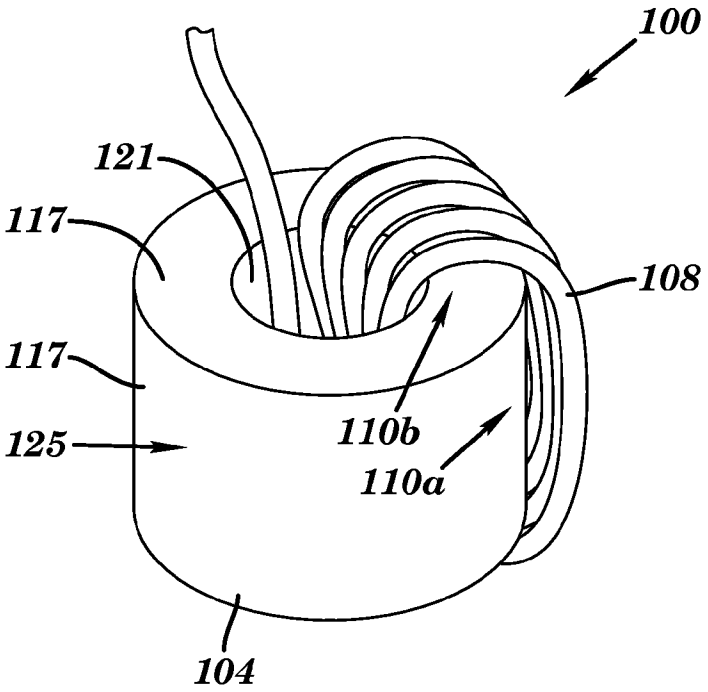
FIG. 1A is a perspective view of a radio frequency (RF) transformer, in accordance with embodiments of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring now to the drawings, wherein like reference numerals refer to like parts throughout, there is seen in FIG. 1A a perspective view of a radio frequency (RF) transformer 100, in accordance with embodiments of the present invention. RF transformer 100 may include a ferrite core 104 and a winding (coil) structure 108. Ferrite core 104 may include multiple ferrite material types arranged in a non-uniform manner. Winding structure 108 is in electrical contact with interior surface 121 of ferrite core 104. RF transformer 100 may be formed such that air gaps 110*a* and 110*b* are formed between winding structure 108 and an exterior surface 117 of ferrite core 104. Air gaps 110*a* and 110*b* essentially electrically and physically space winding structure 108 from exterior surface 117 of ferrite core 104. Additionally, spacers (e.g., spacers 120 in FIG. 1B as described, infra) may be strategically placed between winding structure 108 and ferrite core 104. Spacers 120 essentially electrically and physically space winding structure 108 from exterior surface 117 of ferrite core 104. Alternatively, ferrite core 104 may include an electrically insulative material 125 formed over an exterior surface 117 of ferrite core 104. The insulative material 125 is not formed over interior surface 121 of the ferrite core 104. Electrically insulative material 125 electrically and physically spaces winding structure 108 from exterior surface 117 of ferrite core 104. Winding structure 108 includes turns of a relatively fine gauge insulated wire (e.g., copper) installed on ferrite core 104 to form a group of windings of a specified number of turns and orientation. RF transformer 100 enables a unique combination of performance parameters such as, inter alia:

1. Conveyance of RF signals along an intended path (i.e., insertion loss).
2. A match to system impedance (i.e., return loss). In specific embodiments, a minimization of signal leakage among ports (i.e., isolation).
3. A maintenance of proper operation at low frequencies and cold temperatures (i.e., significantly affected by a specific ferrite material used).
4. Ultimate operation at high frequencies (i.e., significantly affected by specific ferrite material used and a winding arrangement/parasitics).
5. An ability to withstand high signal levels without producing unwanted signals (i.e., intermodulation).
6. An ability to withstand high magnetic excitation without degraded performance (surge).

RF transformer 100 enables manipulation of winding structure 108 with respect to ferrite core 104. At relatively low frequencies, a coupling of energy is magnetic and facilitated by the ferrite (of ferrite core 104). As a frequency rises through approximately 300 MHz, an effectiveness of the ferrite magnetic coupling decreases and a dominant coupling occurs via a capacitive (proximity) coupling among the windings. At the higher frequencies (i.e., greater than about 300 MHz), presence of the ferrite may add to parasitic losses. RF transformer 100 provides an ability to blend multiple types of ferrite materials in order to manage frequency performance at high and low frequencies. Additionally, RF transformer 100 provides an ability to generate portions of winding structure 108 that are not closely coupled (i.e., spaced away from) to ferrite core 104. Generating portions of winding structure 108 that are not closely coupled (i.e., spaced away from) to ferrite core 104 may be accomplished by using individual pieces of material (e.g., ferrous or non-ferrous, conductive or nonconductive) such as spacers situated between ferrite core 104 and winding structure 108 and/or within winding structure 108.

Figure 1C:
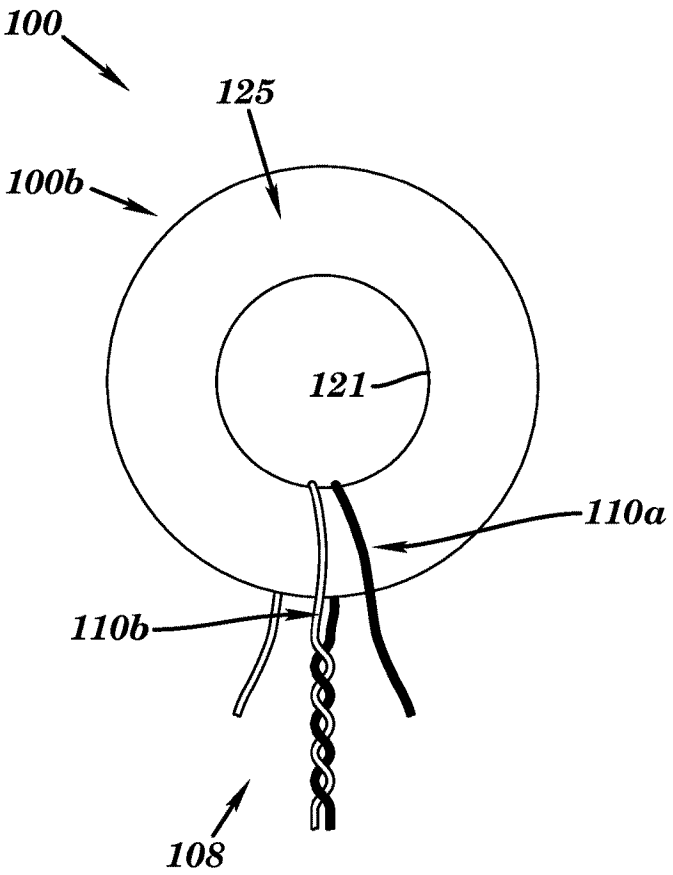
FIG. 1C is a top view of the RF transformer of FIG. 1A, in accordance with embodiments of the present invention.
Figure 1B:
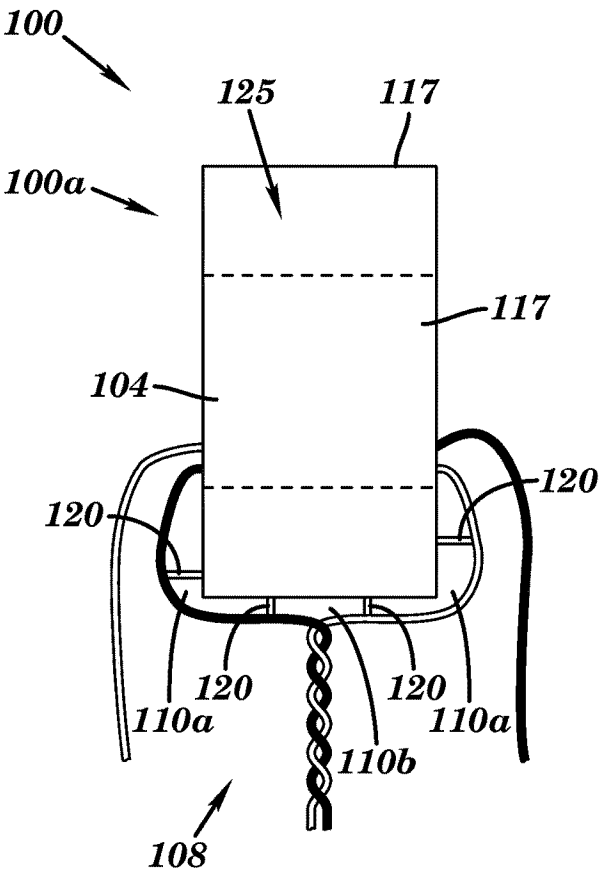
FIG. 1B is a side view of the RF transformer of FIG. 1A, in accordance with embodiments of the present invention.

Referring further to FIG. 1B, there is seen a side view 100*a* of RF transformer 100 of FIG. 1A, in accordance with embodiments of the present invention. FIG. 1B illustrates spacers 120 used to separate winding structure 108 from exterior surface 117 of core structure 104. Spacers 120 may comprise any type of operable spacers that include any size, shape, and/or material. For example, spacers 120 may comprise plastic, fiberglass, an insulator material, a dielectric material, etc.

Referring further to FIG. 1C, there is seen a top view 100*b* of RF transformer 100 of FIG. 1A, in accordance with embodiments of the present invention.

Figure 2A:
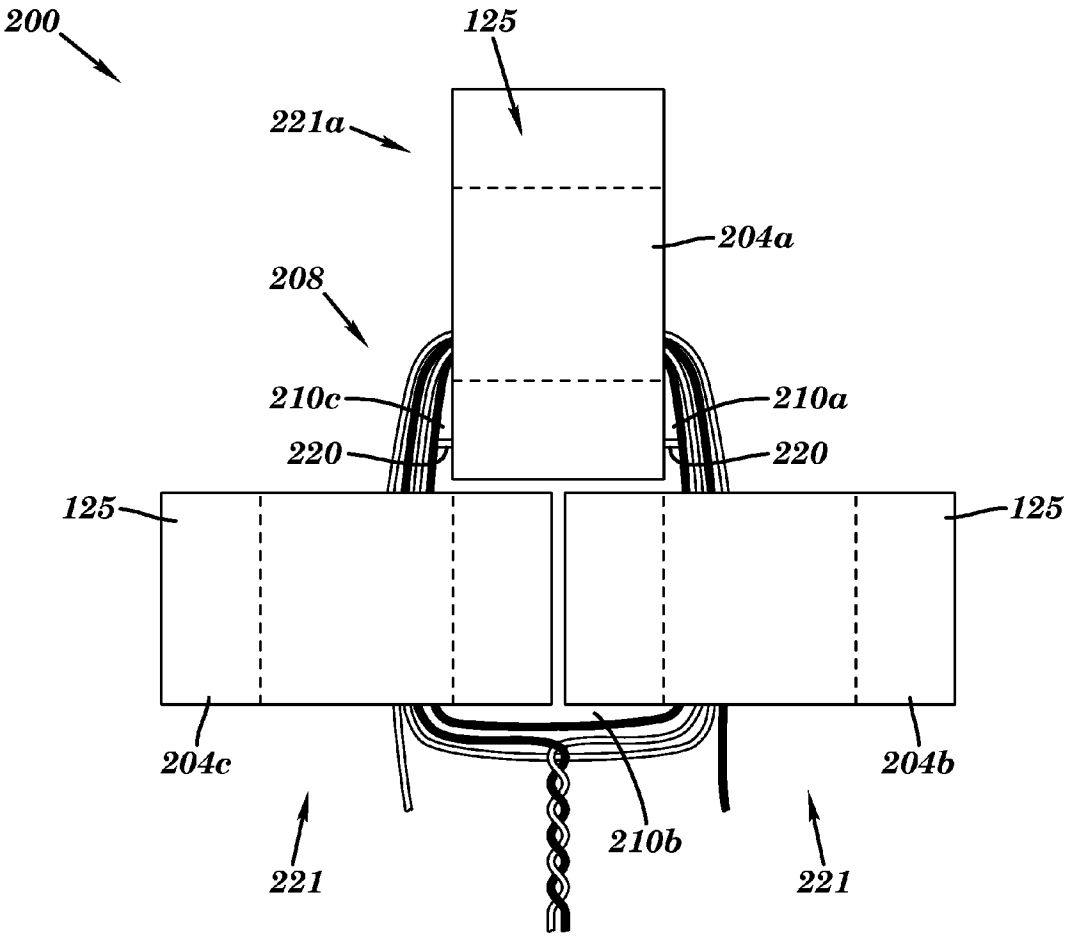
FIG. 2A is a side view of a multicore RF transformer, in accordance with embodiments of the present invention.

Referring further to FIG. 2A, there is seen a side view of a multicore RF transformer 200, in accordance with embodiments of the present invention. Multicore RF transformer 200 comprises multiple ferrite cores 204*a*, 204*b*, and 204*c* and a winding (coil) structure 208 strategically formed around ferrite cores 204*a*, 204*b*, and 204*c*. Ferrite cores 204*a*, 204*b*, and 204*c* may each include multiple ferrite material types arranged in a non-uniform manner. Each of ferrite cores 204*a*, 204*b*, and 204*c* may comprise a same size, shape, and material. Alternatively, each of ferrite cores 204*a*, 204*b*, and 204*c* may comprise a different size, shape, and/or material. Winding structure 208 is in electrical contact with interior surfaces of ferrite cores 204*a*, 204*b*, and 204*c*. Multicore RF transformer 200 may be formed such that air gaps 210*a*, 210*b*, and 210*c* are formed between winding structure 208 and exterior surfaces of ferrite cores 204*a*, 204*b*, and 204*c*. Air gaps 210*a*, 210*b*, and 210*c* essentially electrically and physically space winding structure 208 from exterior surfaces of ferrite cores 204*a*, 204*b*, and 204*c*. Additionally, spacers 220 may be strategically placed between winding structure 208 and ferrite cores 204*a*, 204*b*, and 204*c*. The spacers essentially electrically and physically space winding structure 208 from exterior surfaces of ferrite cores 204*a*, 204*b*, and 204*c*. Alternatively and/or additionally, ferrite cores 204*a*, 204*b*, and 204*c* may each include an electrically insulative material 125 formed over exterior surfaces of ferrite cores 204*a*, 204*b*, and 204*c*. The insulative material 125 is not formed over interior surfaces 221 of ferrite cores 204*a*, 204*b*, and 204*c*. Electrically insulative material 125 electrically and physically spaces winding structure 208 from exterior surfaces of ferrite cores 204*a*, 204*b*, and 204*c*.

The use of multiple ferrite cores (e.g., ferrite cores 204*a*, 204*b*, and 204*c*) allows potential selection of multiple different types of ferrite thereby allowing a designer additional flexibility to blend desirable properties of different ferrite material types. The use of multiple ferrite cores of a same type of ferrite material may additionally segmenting of a ferrite medium. Additionally, multicore RF transformer 200 enables an overall winding structure comprising a unique shape offering enhanced parasitics thereby allowing a high frequency performance. Generating portions of winding structure 208 that are not closely coupled (i.e., spaced away from) to ferrite cores 204*a*, 204*b*, and 204*c* may be accomplished by selecting different ferrite sizes or shapes and/or arranging ferrite cores 204*a*, 204*b*, and 204*c* in such a way as to create gaps between winding structure 208 and ferrite cores 204*a*, 204*b*, and 204*c* at specified areas.

Figure 2B:
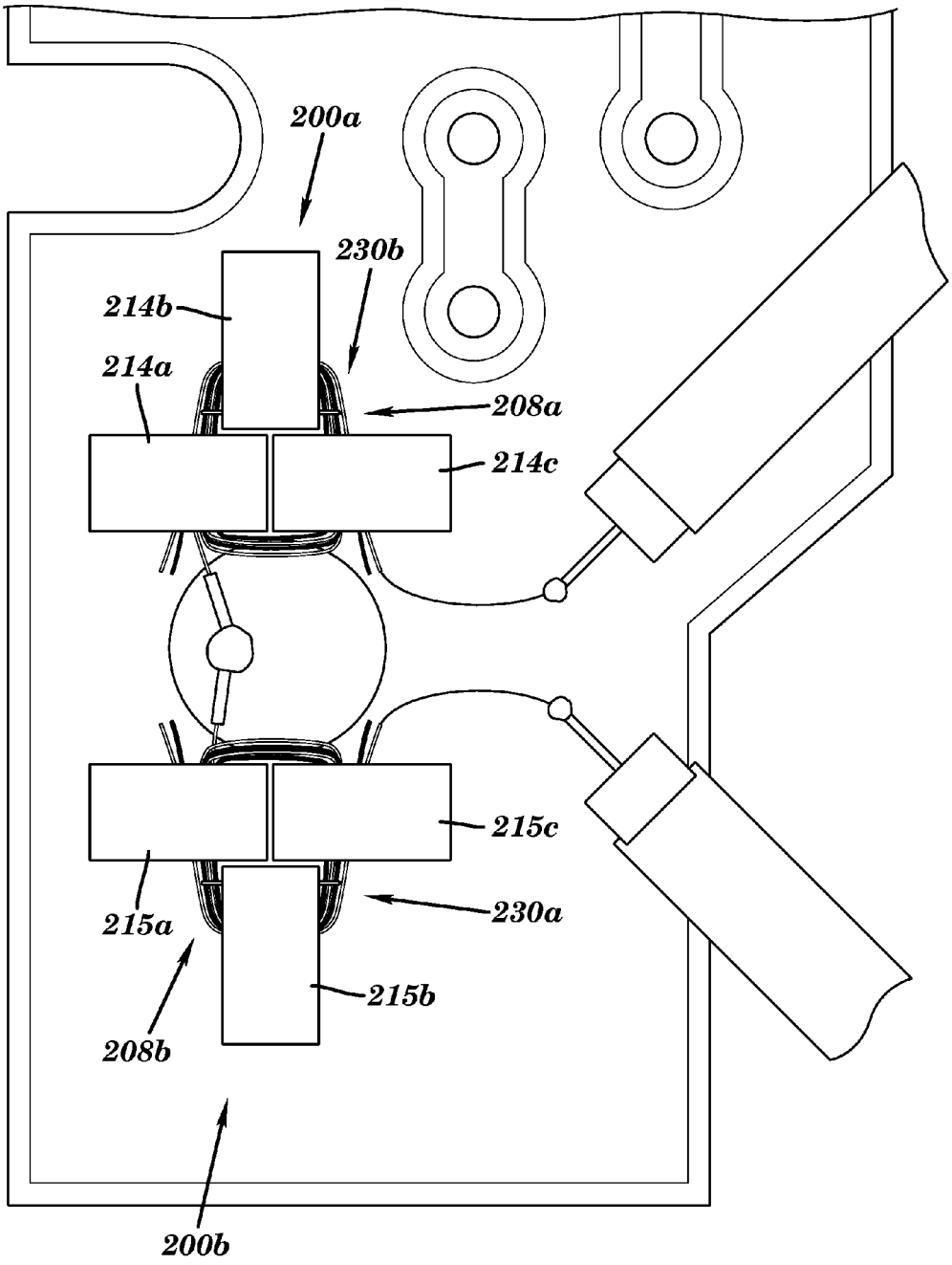
FIG. 2B is a perspective view of a multiple multicore RF transformers, in accordance with embodiments of the present invention.

Referring further to FIG. 2B, there is seen a perspective view of a multicore RF transformer 200*a* connected to a multicore RF transformer 200*b*, in accordance with embodiments of the present invention. Multicore RF transformer 200*a* is electrically and physically connected to a multicore RF transformer 200*b*. Multicore RF transformer 200*a* comprises multiple ferrite cores 214*a*, 214*b*, and 214*c* and a winding (coil) structure 208*a* strategically formed around ferrite cores 214*a*, 214*b*, and 214*c*. Ferrite cores 214*a*, 214*b*, and 214*c* may each include multiple ferrite material types arranged in a non-uniform manner. Each of ferrite cores 214*a*, 214*b*, and 214*c* may comprise a same size, shape, and material. Alternatively, each of ferrite cores 214*a*, 214*b*, and 214*c* may comprise a different size, shape, and/or material. Winding structure 208*a* is in electrical contact with interior surfaces of ferrite cores 214*a*, 214*b*, and 214*c*. Multicore RF transformer 200 may be formed such that air gaps 230*a* are formed between winding structure 208*a* and exterior surfaces of ferrite cores 214*a*, 214*b*, and 214*c*. Air gaps 230*a* essentially electrically and physically space winding structure 208*a* from exterior surfaces of ferrite cores 214*a*, 214*b*, and 214*c*. Additionally, spacers (e.g., spacers 220 of FIG. 2A) may be strategically placed between winding structure 208*a* and ferrite cores 204*a*, 204*b*, and 204*c*. The spacers essentially electrically and physically space winding structure 208*a* from exterior surfaces of ferrite cores 214*a*, 214*b*, and 214*c*. Alternatively and/or additionally, ferrite cores

214*a*, 214*b*, and 214*c* may each include an electrically insulative material formed over exterior surfaces of ferrite cores 214*a*, 214*b*, and 214*c*. The insulative material is not formed over interior surfaces of ferrite cores 214*a*, 214*b*, and 214*c*. The electrically insulative material electrically and physically spaces winding structure 208*a* from exterior surfaces of ferrite cores 214*a*, 214*b*, and 214*c*. Multicore RF transformer 200*b* comprises multiple ferrite cores 215*a*, 215*b*, and 215*c* and a winding (coil) structure 208*b* strategically formed around ferrite cores 215*a*, 215*b*, and 215*c*. Ferrite 215*a*, 215*b*, and 215*c* may each include multiple ferrite material types arranged in a non-uniform manner. Each of ferrite cores 215*a*, 215*b*, and 215*c* may comprise a same size, shape, and material. Alternatively, each of ferrite cores 215*a*, 215*b*, and 215*c* may comprise a different size, shape, and/or material. Winding structure 208*b* is in electrical contact with interior surfaces of ferrite cores 215*a*, 215*b*, and 215*c*. Multicore RF transformer 200*b* may be formed such that air gaps 230*b* are formed between winding structure 208*b* and exterior surfaces of ferrite cores 215*a*, 215*b*, and 215*c*. Air gaps 230*b* essentially electrically and physically space winding structure 208*b* from exterior surfaces of ferrite cores 215*a*, 215*b*, and 215*c*. Additionally, spacers (e.g., spacers 220 of FIG. 2A) may be strategically placed between winding structure 208*b* and ferrite cores 215*a*, 215*b*, and 215*c*. The spacers essentially electrically and physically space winding structure 208*b* from exterior surfaces of ferrite cores 215*a*, 215*b*, and 215*c*. Alternatively and/or additionally, ferrite cores 215*a*, 215*b*, and 215*c* may each include an electrically insulative material formed over exterior surfaces of ferrite cores 215*a*, 215*b*, and 215*c*. The insulative material is not formed over interior surfaces of ferrite cores 215*a*, 215*b*, and 215*c*. The electrically insulative material electrically and physically spaces winding structure 208*b* from exterior surfaces of ferrite cores 215*a*, 215*b*, and 215*c*.

Figure 3:
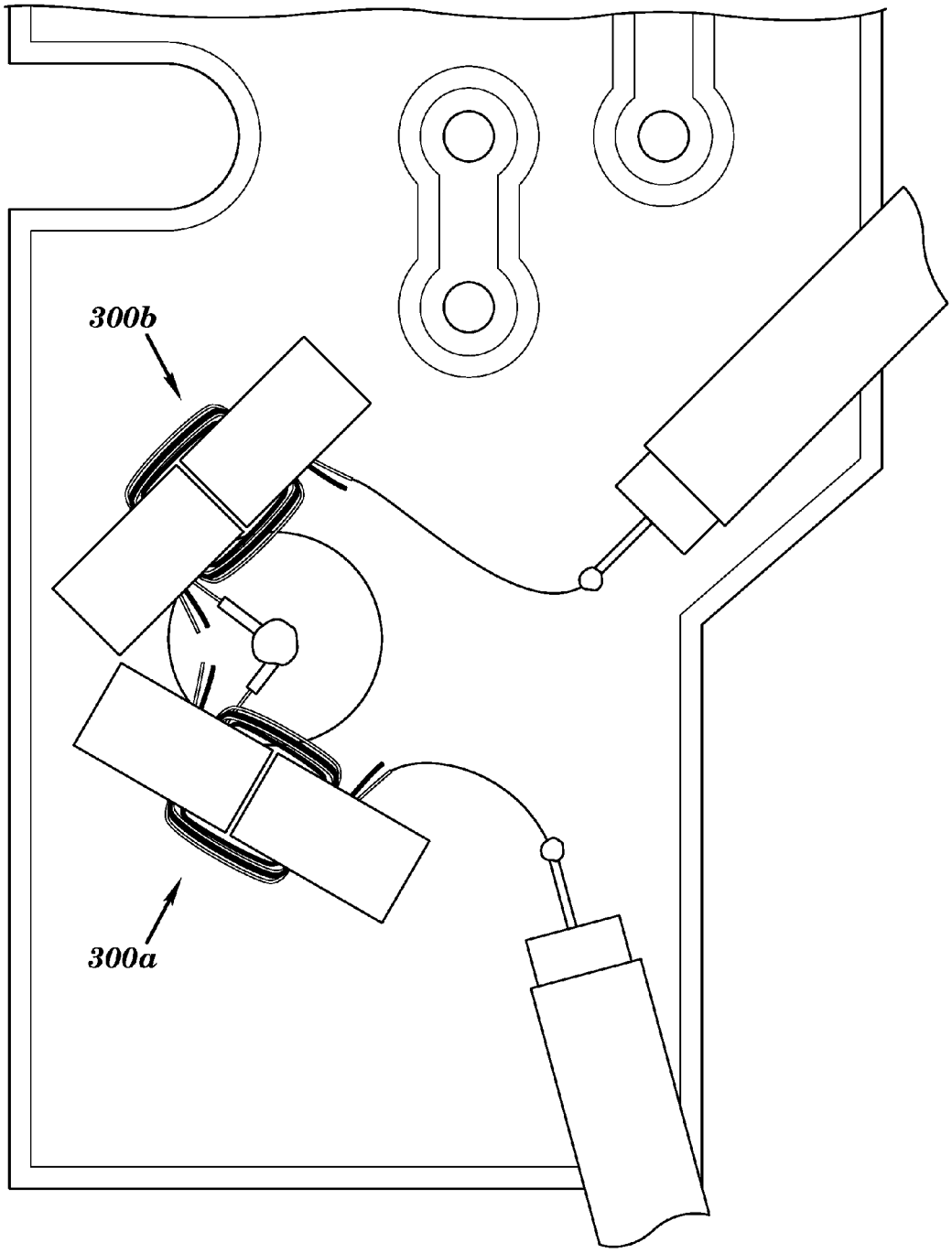
FIG. 3 is a perspective view of a multicore RF transformer 300*a* connected to another multicore RF transformer, in accordance with embodiments of the present invention.

Referring further to FIG. 3, there is seen a perspective view of a multicore RF transformer 300*a* connected to a multicore RF transformer 300*b*, in accordance with embodiments of the present invention. Multicore RF transformer 300*a* is electrically and physically connected to a multicore RF transformer 300*b*.

Figure 4:
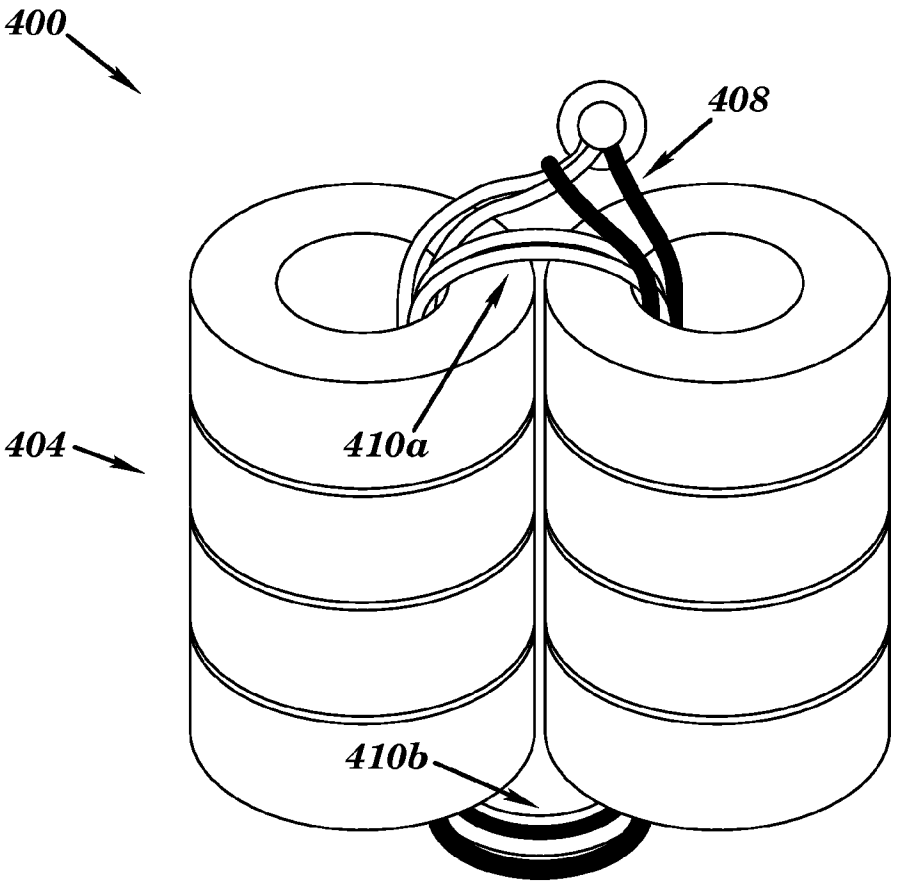
FIG. 4 is a perspective view of an alternative multicore RF transformer, in accordance with embodiments of the present invention.

Referring further to FIG. 4, there is seen a perspective view of a multicore RF transformer 400, in accordance with embodiments of the present invention. Multicore RF transformer 400 comprises multiple (i.e., eight) ferrite cores 404 and a winding (coil) structure 408 strategically formed around ferrite cores 404. Ferrite cores 404 may each include multiple ferrite material types arranged in a non-uniform manner. Each of ferrite cores 404 may comprise a same size, shape, and material. Alternatively, each of ferrite cores 404 may comprise a different size, shape, and/or material. Winding structure 408 is in electrical contact with interior surfaces of ferrite cores 404. Multicore RF transformer 400 may be formed such that air gaps 410*a* and 410*b* are formed between winding structure 408 and exterior surfaces of ferrite cores 404. Air gaps 410*a* and 410*b* essentially electrically and physically space winding structure 408 from exterior surfaces of ferrite cores 404. Additionally, spacers (e.g., spacers of FIG. 220 of FIG. 2A) may be used to electrically and physically space winding structure 408 from exterior surfaces of ferrite cores 404.

Figure 5:
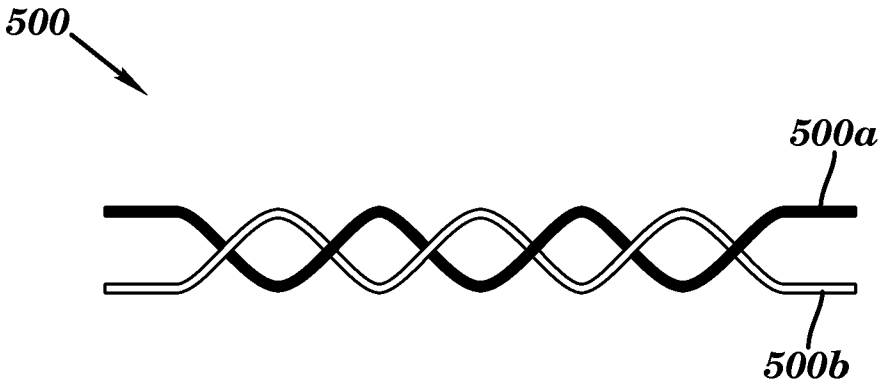
FIG. 5 is a side view of a twisted wire pair, in accordance with embodiments of the present invention.

Referring further to FIG. 5, there is seen a side view of a twisted wire pair 500 used in a winding structure for an RF transformer, in accordance with embodiments of the present invention. Twisted wire pair 500 comprises a center twisted winding of a matching transformer. Twisted wire pair 500 of FIG. 5 may be used for RF transformer 600*a* of FIG. 6A and/or RF transformer 600*b* of FIG. 6B as described, infra. Twisted wire pair 500 comprises a wire portion 500*a* twisted with a wire portion 500*b* and depending on a performance of parameters (such as, inter alia, isolation, insertion loss, return loss, etc.), a number of twists may be adjusted. Twisted wire pair 500 of FIG. 5 may be placed as a middle turn of a winding structure on a ferrite core (i.e., as illustrated in FIGS. 6A and 6B).

Figure 6B:
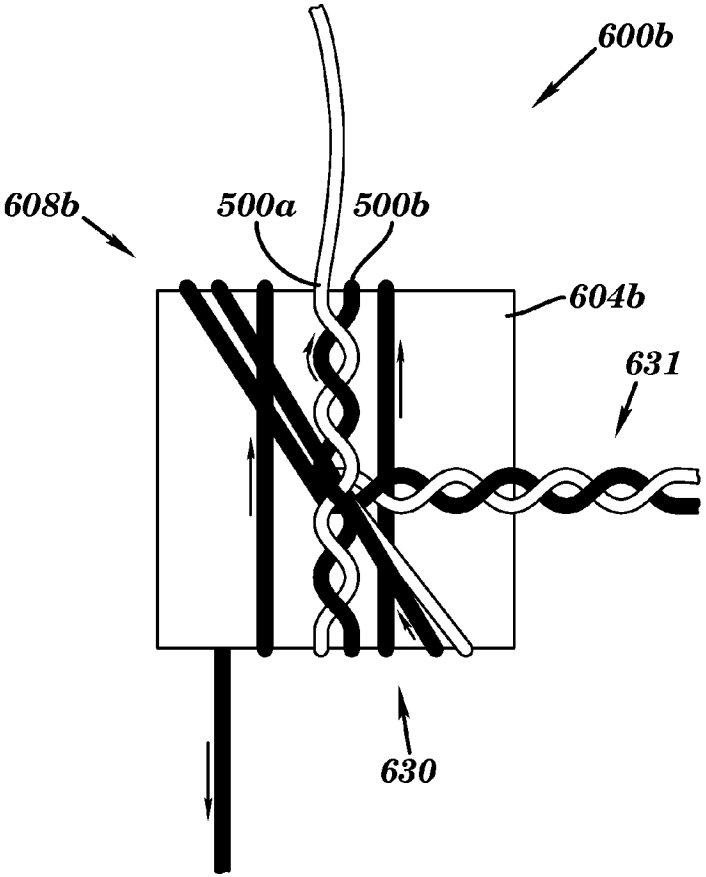
FIG. 6B is a side view of an RF transformer comprising multiple twisted wire pairs, in accordance with embodiments of the present invention.
Figure 6A:
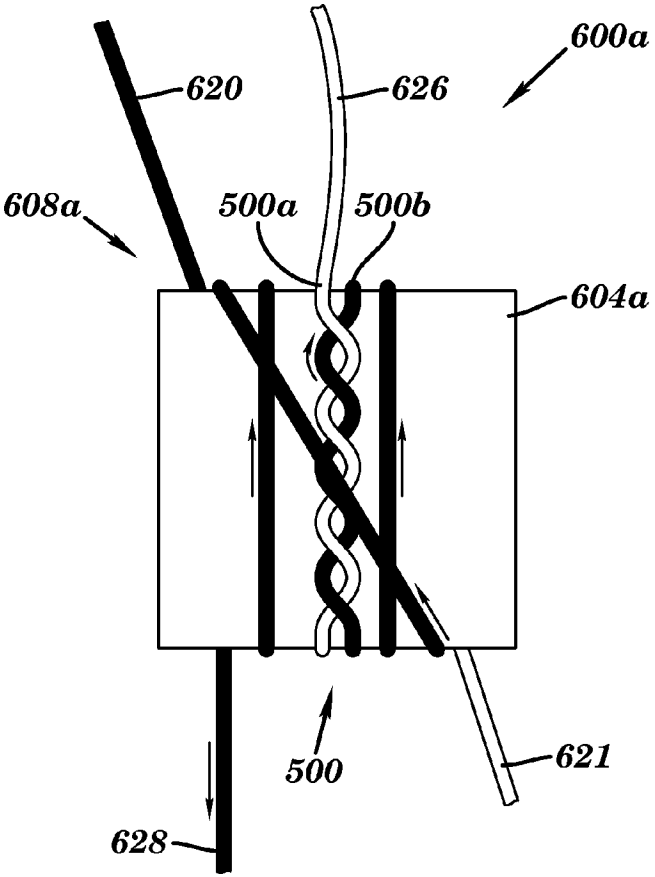
FIG. 6A is a side view of an RF transformer comprising a twisted wire pair, in accordance with embodiments of the present invention.

Referring further to FIG. 6A, there is seen a side view of an RF transformer 600*a* comprising a winding structure 608*a*, in accordance with embodiments of the present invention. RF transformer 600*a* (i.e., matching transformer) illustrates common leads (i.e., wires 620 and 621) before twisting the common leads together as illustrated in FIG. 6B, infra. RF transformer 600*a* comprises winding structure 608*a* formed around a ferrite core 604*a*. Ferrite core 604*a* may include multiple ferrite material types arranged in a non-uniform manner. Twisted wire pair 500 is formed by twisting wire portion 500*b* of wire 620 with wire portion 500*a* of wire 621. Wire 626 comprises an input wire and wire 628 comprises a ground wire. An orientation of multiple turns (i.e., of twisted wire pairs) on ferrite core 604*a* of the matching transformer enables specified performance parameters. For example, as a frequency rises at relatively low frequencies, a coupling is generally magnetic and facilitated by a ferrite material. As frequency rises through approximately 300 MHz, an effectiveness of the ferrite magnetic coupling decreases and a dominant coupling occurs via capacitive (proximity) coupling among the windings themselves.

Referring further to FIG. 6B, there is seen a side view of an RF transformer 600*b* comprising a winding structure 608*b*, in accordance with embodiments of the present invention. FIG. 6B shows a common end twisted wire pair 631 as a final look of the matching transformer. Twisted wire pair 631 includes tinned ends in order to removed insulation from the wires. Therefore, the tinned become a connection point between a matching transformer and a splitting transformer. Winding numbers show the orientation of the windings that also results in a broadband response. RF transformer 600*b* comprises winding structure 608*b* formed around a ferrite core 604*b*. Ferrite core 604*b* may include multiple ferrite material types arranged in a non-uniform manner. Winding structure 608*b* comprises a twisted wire pair 630 and 631 (i.e., common leads such as wires 620 and 621 twisted together) for a matching transformer. Providing twisted wire pairs at a center of a winding scheme increases a high frequency coupling to result in preferred loss characteristics and matching for a broadband spectrum from about 5 MHz to about 1700 MHz.

Referring further to FIGS. 7A-7J, there is seen a process for building RF transformer 600*b* (i.e., using side views) of FIG. 6B, in accordance with embodiments of the present invention.

Figure 7B:
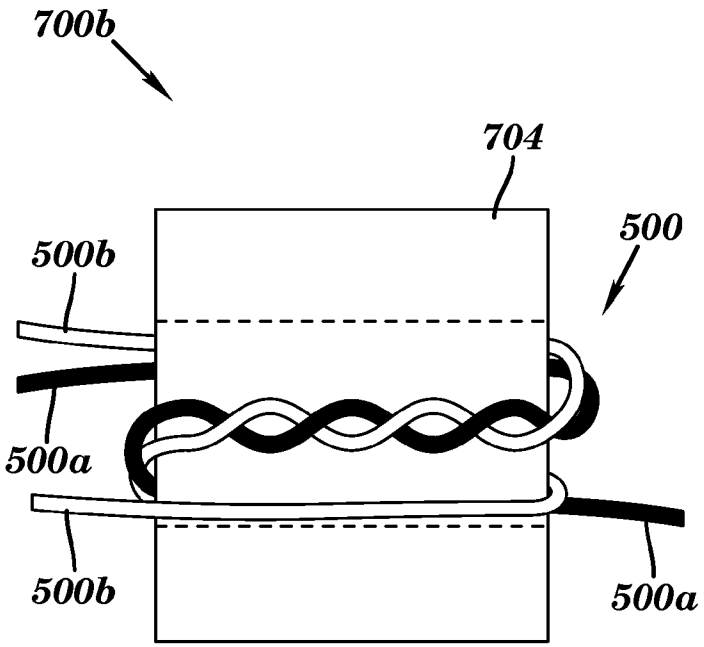
FIGS. 7A-7J illustrate a process for building the RF transformer of FIG. 6B, in accordance with embodiments of the present invention.
Figure 7A:
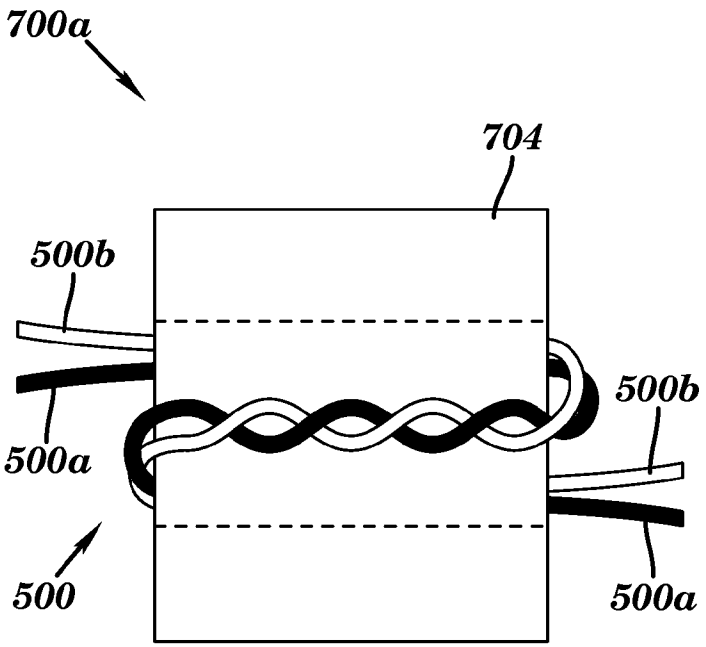

FIG. 7A illustrates a first step 700*a* for forming RF transformer 600*b* comprising twisted wire pair 500 (i.e., described in FIG. 5 and including a wire portion 500*a* twisted with a wire portion 500*b*) formed around ferrite core 704.

FIG. 7B illustrates a second step 700*b* for forming RF transformer 600*b*. The second step 700*b* includes forming another turn of wire portion 500*b* through a center of and around ferrite core 704.

Figure 7D:
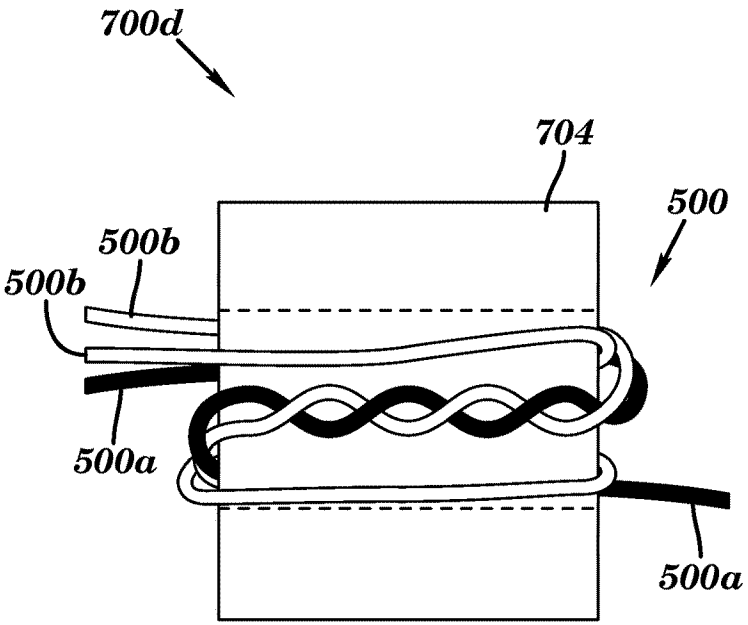
Figure 7C:
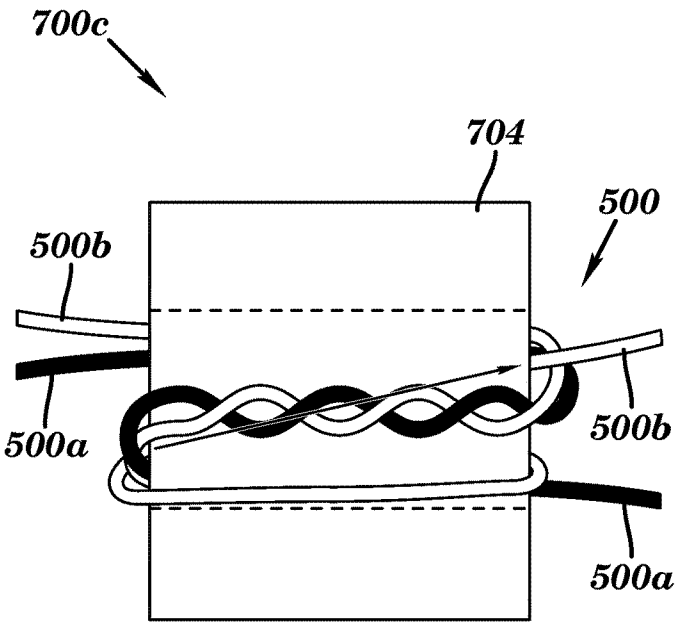

FIG. 7C illustrates a third step 700*c* for forming RF transformer 600*b*. The third step 700*c* includes forming another turn of wire portion 500*b* through the center of ferrite core 704.

FIG. 7D illustrates a fourth step 700*d* for forming RF transformer 600*b*. The fourth step 700*d* includes forming wire portion 500*b* across an outside portion of ferrite core 704.

Figure 7F:
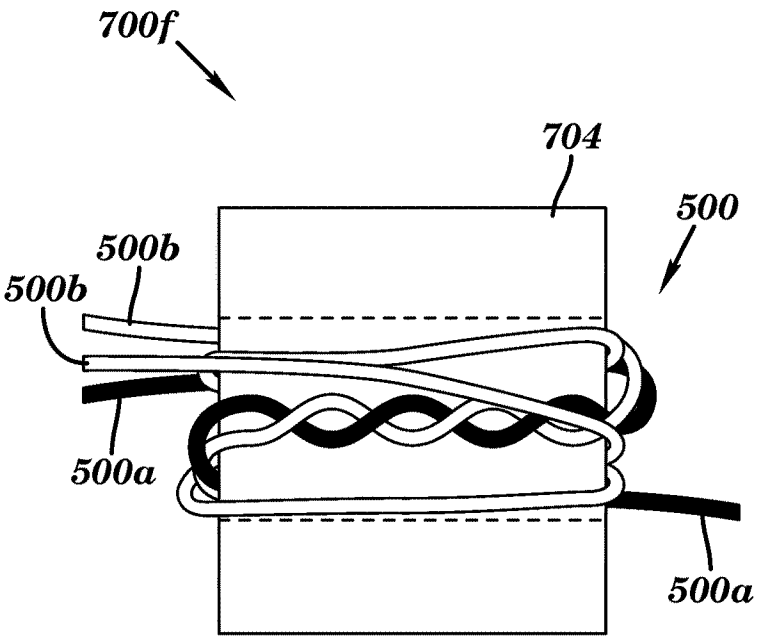
Figure 7E:
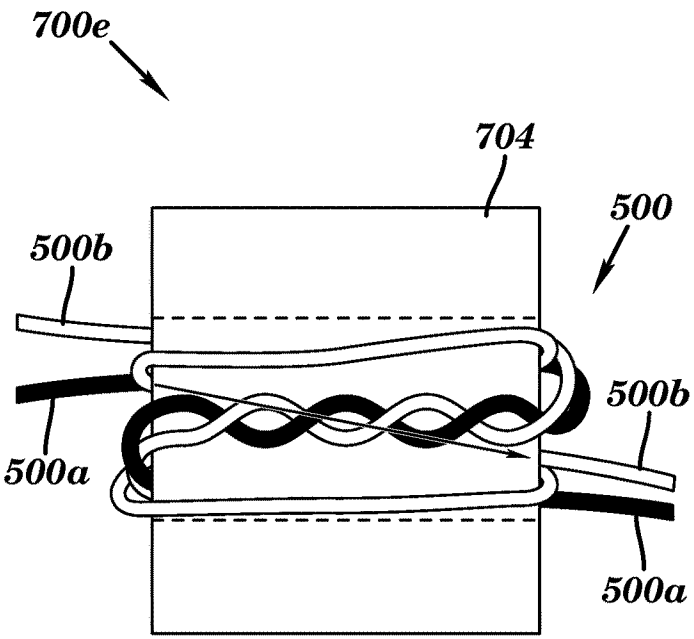

FIG. 7E illustrates a fifth step 700*e* for forming RF transformer 600*b*. The fifth step 700*e* includes forming another turn of wire portion 500*b* through the center of ferrite core 704.

FIG. 7F illustrates a sixth step 700*f* for forming RF transformer 600*b*. The sixth step 700*f* includes forming another turn of wire portion 500*b* across an outside portion of ferrite core 704 and across twisted wire pair 500.

Figure 7H:
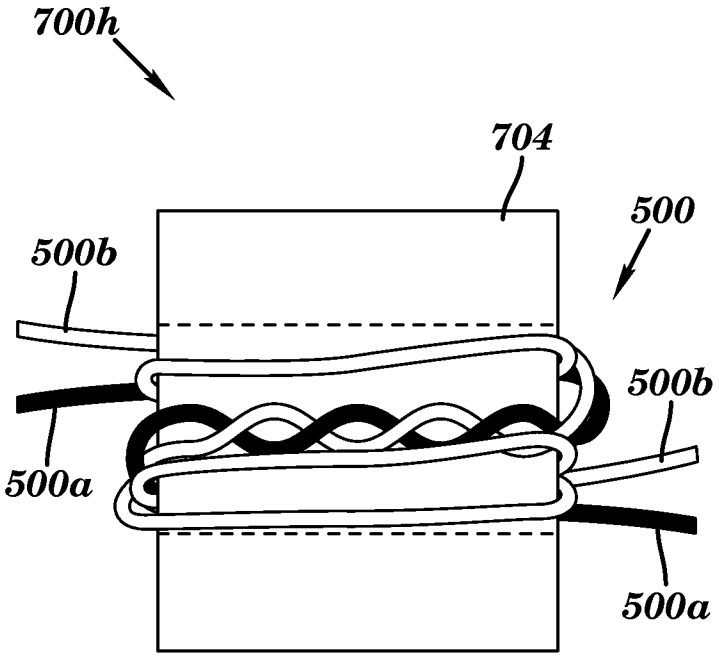
Figure 7G:
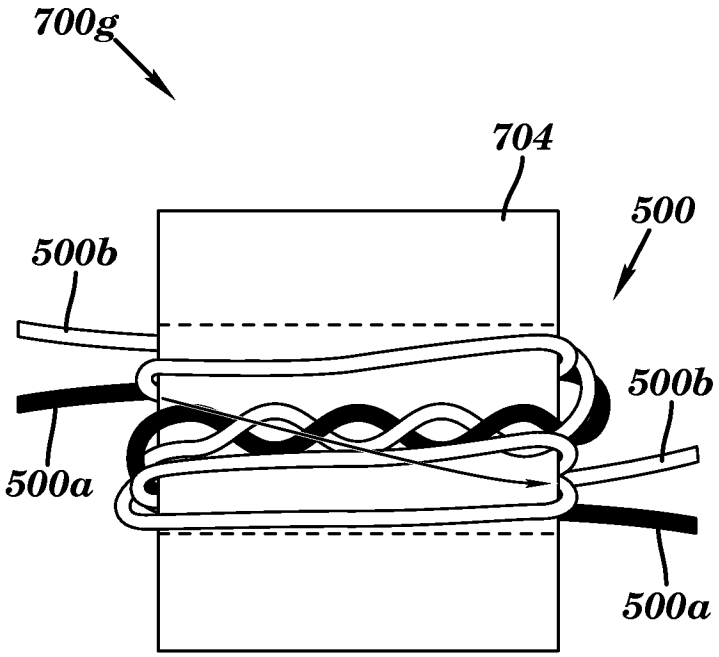

FIG. 7G illustrates a seventh step 700*g* for forming RF transformer 600*b*. The seventh step 700*g* includes forming another turn of wire portion 500*b* through the center of ferrite core 704.

FIG. 7H illustrates an eighth step 700*h* for forming RF transformer 600*b*. The eighth step 700*h* includes twisting wire portion 500*a* with wire portion 500*b*.

Figure 7J:
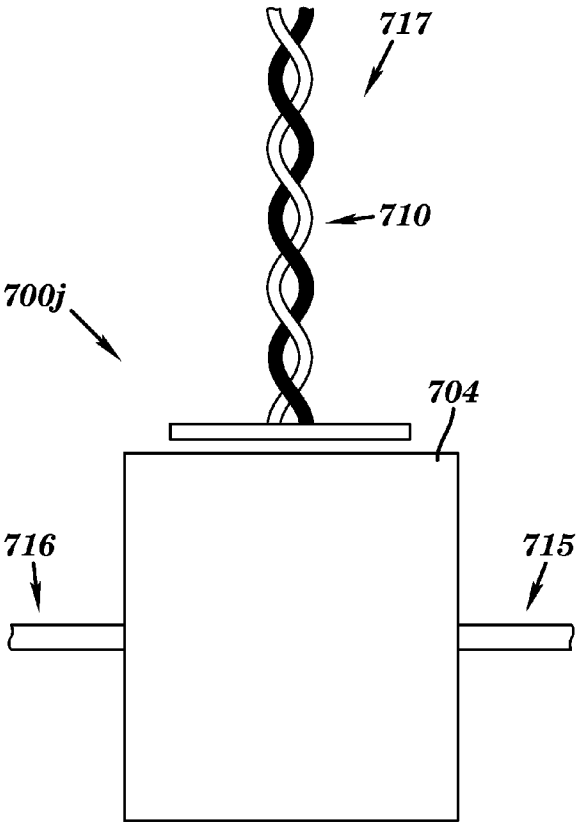
Figure 7I:
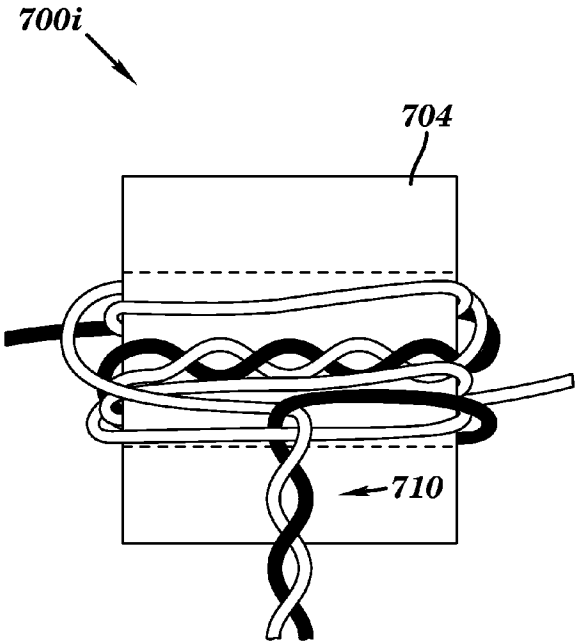

FIG. 7I illustrates a ninth step 700*i* for forming RF transformer 600*b*. The ninth step 700*i* includes twisting wire portion forming a tap portion 710.

FIG. 7J illustrates a tenth step 700*j* for forming RF transformer 600*b*. The tenth step includes tinning all exposed leads 715, 716, and 717.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A transformer comprising:

a core having a toroidal shape;

at least one pair of conductive wires wound about an outer surface of the core, the at least one pair of conductive wires electrically contacting a first portion of the outer surface; and one or more spacers forming one or more air gaps configured to allow a liquid to pass between the at least one pair of conductive wires and a second portion of the outer surface, wherein:

the core is configured to couple a low bandwidth signal across the at least one pair of conductive wires through magnetic coupling;

the at least one pair of conductive wires comprises a twisted portion including a plurality of consecutive twists;

the plurality of consecutive twists is configured to couple a high bandwidth signal across the at least one pair of conductive wires through a combination of a magnetic coupling and a capacitive coupling;

a magnitude of the capacitive coupling is proportional to a number of the plurality of the consecutive twists;

the core is a toroidal shaped member disposed in a radial plane and is comprised of a ferrite material;

the at least one pair of conductive wires comprises a pair of untwisted wire leads extending from the twisted portion around the outer surface of the core;

the twisted portion is substantially coplanar with the radial plane;

the one or more spacers forming the one or more air gaps comprise:

a first spacer extending radially from the second portion of the outer surface of the toroidal shaped member;

a second spacer extending axially from the second portion of the outer surface of the toroidal shaped member; and a third spacer extending axially from the outer surface of toroidal shaped member; and the one or more air gaps comprise:

a first air gap between the first spacer and the second spacer; and a second air gap between the first spacer and the third spacer.

2. The transformer of claim 1, wherein the plurality of consecutive twists wound about the outer surface are configured to increase the capacitive coupling when the bandwidth increases above about 300 Mhz.

3. The transformer of claim 1, wherein:

the toroidal shape of the core defines a ring disposed in a radial plane, the twisted portion is substantially coplanar with the radial plane of the toroidal shaped core.

4. The transformer of claim 3, wherein:

at least one of the pair of untwisted wire leads crosses over the twisted portion upon a subsequent revolution of the at least one of the pair of untwisted wire leads.

5. The transformer of claim 1, wherein the plurality of consecutive twists comprises a twisted portion extending linearly from the outer surface of the ferrite core.

6. A transformer comprising:

a ferrite core comprising a toroidal-shaped member disposed in a radial plane, the toroidal-shaped member comprising an interior surface and exterior surfaces, the interior surface comprising an inner ring of the toroidal-shaped member, and the outer surfaces comprising an outer ring of the toroidal-shaped member, a top surface of the toroidal-shaped member, and the bottom surface of the toroidal-shaped member;

at least one pair of conductive wires wound about the ferrite core, the at least one pair of conductive wires directly contacting the interior surface of the toroidal-shaped member;

a plurality of spacers forming a plurality of air gaps between the plurality of spacers, the at least one pair of conductive wires, and the outer surfaces of the toroidal-shaped member;

wherein:

the plurality of air gaps are configured to allow a liquid to pass between the at least one pair of conductive wires and the outer surfaces of the ferrite core, the at least one pair of conductive wires comprises a twisted portion including a plurality of consecutive twists, the twisted portion is substantially coplanar with the radial plane;

the at least one pair of conductive wires comprises a pair of untwisted wire leads extending from the twisted portion around the outer surfaces of the core and the inner surface of the core;

the plurality of spacers comprise:

a first spacer extending radially outward from the outer ring of the toroidal shaped member;

a second spacer extending axially from the top surface of the toroidal-shaped member; and a third spacer extending axially from the bottom surface of the toroidal-shaped member; and the plurality of gaps comprise:

a first air gap between the first spacer and the second spacer; and a second air gap between the first spacer and the third spacer.

7. The transformer of claim 6, wherein:

the core is configured to couple a low bandwidth signal across the conductive wires through magnetic coupling, the plurality of consecutive twists is configured to couple a high bandwidth signal across the at least one pair of conductive wires through a combination of a magnetic coupling and a capacitive coupling, and the capacitive coupling is configured to generate a capacitive magnitude associated with the high bandwidth signals that is proportional to a number of the plurality of the consecutive twists formed by the at least one pair of conductive wires such that the capacitive magnitude proportionally increases when the number of the plurality of the consecutive twists formed by the at least one pair of conductive wires increases.

8. The transformer of claim 6, wherein the plurality of consecutive twists comprises a twisted portion extending linearly from the outer surface of the ferrite core.

9. The transformer of claim 6, wherein:

at least one of the pair of untwisted wire leads crosses over the twisted portion upon a subsequent revolution of the at least one of the pair of untwisted wire leads.

10. The transformer of claim 7, wherein:

at least one of the pair of wire leads is configured to cross over the twisted portion to augment the capacitive coupling.

11. The transformer of claim 7, wherein the twisted portion is configured to increase the capacitive coupling when the bandwidth increases above about 300 Mhz.

12. The transformer of claim 6, wherein:

a first lead of the pair of untwisted wire leads wraps around the outer surfaces and crosses over the twisted portion upon a subsequent revolution of the lead wrap, and the first lead of the pair of untwisted wire leads and a second lead of the pair of untwisted wire leads are twisted to form a second twisted portion that is generally orthogonal to the twisted portion.

* * * * *